US006802586B2

(12) United States Patent
Forman

(10) Patent No.: US 6,802,586 B2
(45) Date of Patent: Oct. 12, 2004

(54) METHOD AND APPARATUS FOR SOFTWARE UPDATES

(75) Inventor: George H. Forman, Port Orchard, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 635 days.

(21) Appl. No.: 09/794,704

(22) Filed: Feb. 27, 2001

(65) Prior Publication Data

US 2002/0118243 A1 Aug. 29, 2002

(51) Int. Cl.[7] ..... B41J 29/38; B41J 2/175

(52) U.S. Cl. ..... 347/19; 347/86

(58) Field of Search ..... 347/19, 14, 23, 347/29, 33, 86, 30, 31, 7, 12, 10, 11, 8, 9, 85; 399/24, 31, 12, 25; 340/540

(56) References Cited

U.S. PATENT DOCUMENTS

| | | | | |
|---|---|---|---|---|
| 5,812,156 | A | 9/1998 | Bullock et al. | 347/19 |
| 6,113,208 | A | 9/2000 | Benjamin et al. | 347/7 |
| 6,126,265 | A | 10/2000 | Childers et al. | 347/23 |
| 6,520,616 | B1 * | 2/2003 | Parks et al. | 347/19 |

* cited by examiner

*Primary Examiner*—Stephen Meier
*Assistant Examiner*—Charles Stewart, Jr.

(57) ABSTRACT

Consumable components associated with computerized apparatus are provided with memory. The memory is used to store, and provide downloading capability therefrom, upgrade versions of computer code. The upgrade versions of computer code are programs or subroutines of programs associated with a device selected from a group including, the consumable, the associated computerized apparatus, and interactional program code associated with both the consumable device and the associated computing apparatus.

12 Claims, 1 Drawing Sheet

METHOD AND APPARATUS FOR SOFTWARE UPDATES

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO AN APPENDIX

Not Applicable.

BACKGROUND OF THE INVENTION

1. Field of the Invention

The present invention relates generally to providing installed-base computing apparatus with software updates using consumables associated with computing apparatus as a carrier. Using an exemplary embodiment to describe the invention, an ink-jet hard copy apparatus' controller firmware or apparatus driver software on a host computer connected to the hard copy apparatus is updated using the replaceable ink-jet ink cartridge device employed by the apparatus.

2. Description of Related Art

Substantially all present-day computers, calculating devices and instruments, computer peripherals—such as printers, scanners, digital senders, facsimile machines, copiers—and the like, include a microprocessor-based controls, generally in the form of a printed circuit board. Such computerized apparatus generally include a memory device containing computer code instructions, or "firmware." Moreover, in some senses, computer software has become far more important than the computer hardware. For simplicity, all such machines are referred to generically hereinafter as "computerized apparatus". Further, some computing devices have consumable devices—such as an ink-jet cartridge for an ink-jet printer—or upgradable plug-in devices—such as PCMCIA cards in portable computers, SIMMs cards, font cartridges, and the like—regularly used in association with the computing apparatus or peripheral.

U.S. Pat. No. 6,126,265 (Childers et al.)(assigned to the common assignee herein and incorporated herein by reference) describes an INK JET PRINTER SERVICE STATION CONTROLLED BY DATA FROM CONSUMABLE PARTS WITH INCORPORATED MEMORY DEVICES. A memory for tracking ink-jet printer operations with respect to the print cartridge is provided so that predetermined service requirements can be implemented using the ink-jet printer service station. "The control data may be service station parameters, one or more subroutines to control the service station and combinations thereof." (Childers et al., Abstract) The controller or computer host must already be programmed to understand and work with the parameters or subroutines and the data stored in the memory.

Similarly, U.S. Pat. No. 6,113,208 (Benjamin et al.) (assigned to the common assignee herein and incorporated herein by reference) describes a REPLACEABLE CARTRIDGE FOR A PRINTER INCLUDING RESIDENT MEMORY WITH STORED MESSAGE TRIGGERING DATA. Messages regarding newly available printer driver software, consumable re-order information, or other like are transmitted to the computer of the end-user upon insertion of the consumable, replaceable cartridge in the printer.

In the current state of the art, such messages or other upgrade facilities require the end-user to download new software or firmware programs (hereinafter referred to more simply as "code") from the Internet. Not all end-users of computers have internet connections. Thus, other end-user's have to, or choose to, call the original equipment manufacturer ("OEM") to obtain a disk with newer code versions. Only a small percentage of motivated computer users do either, waiting for a problem to occur with their older generation equipment or just waiting to purchase a next generation machine rather than upgrading. As a result, the handling of reported failures is a major cost to OEM's; the OEM call center must first debug the end-user's problem, determine if an updated code is required, then mail the materials. Moreover, there is often a call-back from the end-user seeking installation assistance once the materials are received.

One problem in seeking better means for upgrading code has been the relatively high cost of memory type integrated circuits ("IC") having large enough capacity to carry more than simple instructions or messages. As read-only memory ("ROM") IC's have moved toward commodity pricing, new opportunities arise.

There is a need for providing complete program code updates to end-users of computing devices and computer peripherals.

BRIEF SUMMARY OF THE INVENTION

In its basic aspect, the present invention provides a computer consumable component employed with an associated computerized apparatus, including: the consumable component; and incorporated with the consumable component, a memory; and embedded in the memory, readable program code containing at least one downloadable, upgrade version of program code associated with a device selected from a group including, the consumable component, the associated computerized apparatus, and interactional program code associated with both the consumable device and the associated computing apparatus.

In another aspect, the present invention provides a method for delivering computerized apparatus upgrade program code for computerized apparatus, the apparatus including means for accessing a memory, the method including: providing a consumable associated with a computerized apparatus with a memory; installing the upgrade program code into the memory; and installing program code in the memory for recognizing a requirement for the upgrade program code to be downloaded via the means for accessing a memory.

In still another aspect, the present invention provides a method of doing business, the method including: manufacturing consumables employed with associated computerized apparatus; incorporating upgrade versions of computer code into said consumables; and distributing said consumables to computerized apparatus end-users.

The foregoing summary is not intended to be an inclusive list of all the aspects, objects, advantages, and features of the present invention nor should any limitation on the scope of the invention be implied therefrom. This Summary is provided in accordance with the mandate of 37 C.F.R. 1.73 and M.P.E.P. 608.01(d) merely to apprise the public, and more especially those interested in the particular art to which the invention relates, of the nature of the invention in order to be of assistance in aiding ready understanding of the patent in future searches. Objects, features and advantages of the present invention will become apparent upon consideration of the following explanation and the accompanying drawings, in which like reference designations represent like features throughout the drawings.

The drawings referred to in this specification should be understood as not being drawn to scale.

DETAILED DESCRIPTION OF THE INVENTION

Reference is made now in detail to a specific embodiment of the present invention, which illustrates the best mode presently contemplated by the inventor for practicing the invention. Alternative embodiments are also briefly described as applicable.

Figure 1:
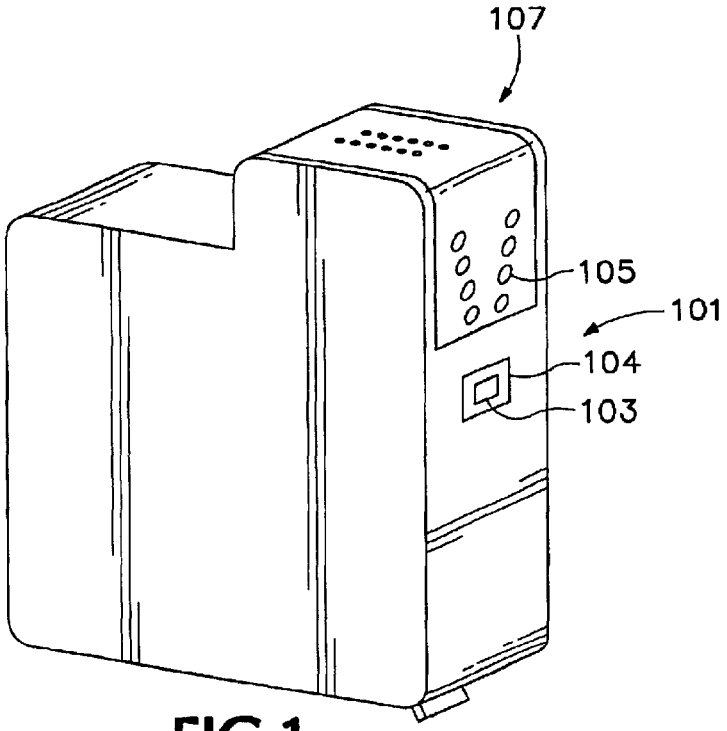
FIG. 1 is an exemplary computer peripheral consumable, an inkjet print cartridge, in accordance with the present invention.

As an exemplary embodiment of a consumable device in accordance with the present invention, FIG. 1 is a schematic, perspective view of a computing device consumable 101. For this example, a plug-in type, ink-jet print cartridge, or more simply "pen," 101, is provided with a memory 103 type integrated circuit, e.g., a ROM or electrically programmable read only memory (EPROM). While an EPROM is more expensive, it offers the advantage to the OEM of standardization during pen manufacture; rather than manufacturing separate ROMs for each upgraded code to be distributed to the installed base, providing each pen, or some subset of the manufacturing run, with an EPROM and programming latest versions of code as necessary.

A suitable IC mount 104 in accordance with common practices in the art is provided. Preferably, the mount 104 should be of the type wherein the IC 103 is easily replaceable yet is protected from inadvertent contact when handling the pen 101. A plurality of electrical contacts 105 enables a plug-in connection to the memory 103 as well as various other known electrical elements within the pen 101 and its integrated printhead 107. A microprocessor-based controller on-board the printer apparatus (not shown) with which such a pen 101 is used is thereby interconnected to the memory 103 via the contacts 105. The controller is provided with known manner memory reading capability (also known in the art as a "ROM reader"). Alternatively, the host computer (not shown) connected to the printer can provide the ROM reading capability, distributing software and firmware code in the memory as instructed thereby.

The upgrade code is loaded into the memory 103 on-board the consumable 101 by the OEM. Note that the upgrade code can be in a compressed format using data compression techniques known in the state of the art. The consumables are shipped to the retailers. Note that the update code needs to be "smart;" particularly, not capable of downgrading the software in a compatible apparatus when the end-user inserts an older version code bearing consumable after a later version code bearing one. Moreover, the update code must be able to recognize known incompatibilities with particular revisions of the computing apparatus' operating system; in such case, it should be able to store the update code until the incompatibility is resolved (e.g., the end-user upgrades the operating system).

Alternative embodiments of the present invention may take into consideration the trade-off between the cost of the memory and the timeliness of the code upgrade. For example, to reduce the size of the ROM, the OEM can break an update onto multiple ROM subsets chosen randomly for each consumable, allowing the controller to accumulate the pieces of the code over time until it has the whole update to process. The end-user can be notified that a partial upgrade has been made available and that selecting the next consumable having an appropriate related packaging message (e.g., "Ver. 2.2, Part 2 upgrade included") will complete the process. Otherwise, the upgrade code can be distributed invisibly to the end-user by providing it in some subset of total consumables sent to the marketplace, taking longer to distribute the upgrade through the installed base, but lowering the OEM overall cost of manufacture. Note that if the consumable's code payload is partial, it may be supplemented by a web site from which the remainder may be immediately obtained if the end-user has internet access. Partial code payloads have an advantage of decreasing the memory size and hence the cost. The upgrade rate can be increased.

Note that the upgrade can be made optional to the end-user; non-upgrade consumables can be so marked and priced lower to the advantage of the end-user. Moreover, code upgrades can be explicitly targeted to an installed base subset of end-users ordering directly from the OEM, e.g., via an established Internet account.

In an alternative embodiment, other carriers and reader technology can be employed rather than using an IC chip to carry the upgrade code. For example, a multi-purpose office machine having a scanner as well as printer, fax, and copier components, can use the scanner to read optically encoded data provided on print media, e.g., on a box of fifty transparencies that might in fact be consumed in only a few days. As another example, laser writeable "blank" compact disks ("CD") can carry the downloadable upgrade code, downloaded when the first disk is put in the CD writing device for a first use; a simple paper information and warning label can advise the end-user that using this particular disk will cause the upgrade process to begin. Similarly, "blank," magnetic, computer backup tapes can also be employed. Use of these and other like types of delivery systems may be far cheaper than IC technology. Furthermore, automatic erasure of the upgrade code can be provided so that after the download, the consumable is then usable for its normal function.

Note that, although a logical choice, the upgrade code need not be specifically related to the consumable interaction with its respective peripheral or host computing apparatus. The exemplary "blank" magnetic tape may contain downloadable upgrade code for the computer operating system rather than the tape machine driver program itself.

Note further that the upgrade code can be interactive, allowing the end-user to select options for installation.

Figure 2:
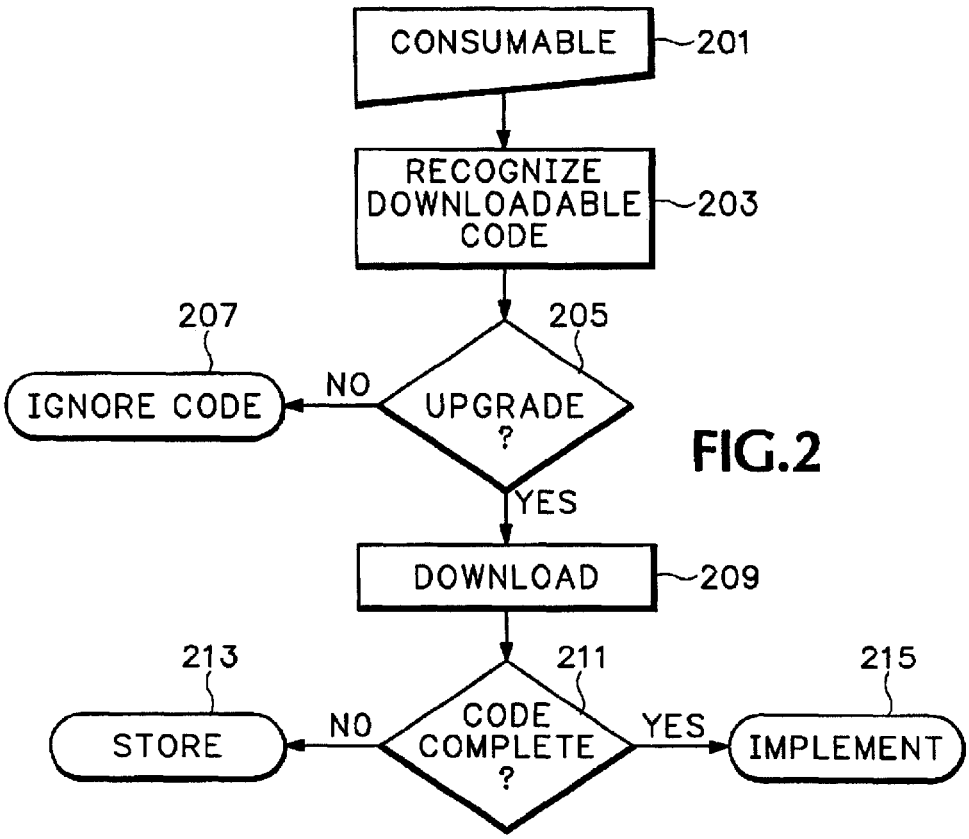
FIG. 2 is a flow chart of the process in accordance with the present invention.

FIG. 2 is a process flow chart for the present invention. The consumable 201 is distributed in the marketplace in the normal flow of doing business. When the end-user makes a first use of the consumable, recognition of the downloadable code occurs, step 203, basically from an initial electrical, optical or magnetic sensing that the consumable 201 has been positioned for use. A decision 205 is rendered, either automatically or through user interaction, as to whether an upgrade is required or advised. If not, the code or download interface subroutine thereof can be erased or ignored 207. If a download is implemented, step 205 Yes-path, the download 209 takes place. Once downloaded, a check 211 is made to determine if the upgrade is partial or complete. If the upgrade code is only partial, step 211 No-path, the code is stored 213 for later additions and ultimate completion. If the upgrade code is complete, step 211, the code is implemented 215.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for . . . " and no process step herein is to be construed under those provisions unless the step or steps are expressly recited using the phrase "comprising the step(s) of . . . . "

What is claimed is:

1. A computer consumable component system employed with an associated computerized apparatus, the system comprising:

a computer consumable component;

incorporated with the consumable component, a memory; and embedded in the memory, readable program code containing at least one downloadable, upgrade version of program code associated with a device selected from a group including, the consumable component, the associated computerized apparatus, and interactional program code associated with both the consumable device and the associated computing apparatus, said program code including program code for indicating whether the readable program code is a partial listing or a complete listing of an upgrade version thereof.

2. The invention as set forth in claim 1, the memory further comprising:

an electrically readable device.

3. The invention as set forth in claim 1, the memory further comprising:

an optically readable device.

4. The invention as set forth in claim 1 the memory further comprising:

a magnetically readable device.

5. The invention as set forth in claim 1 the readable program code further comprising:

interactive subroutines for allowing selection of options for installation, operation, is or both, of said readable program code.

6. The invention as set forth in claim 1 further comprising:

program code for determining if the readable program code is compatible with the associated computerized apparatus and, if not, program code for aborting any downloading of the readable program code.

7. A method for delivering computerized apparatus upgrade program code for computerized apparatus, the apparatus including means for accessing a memory, the method comprising:

providing a consumable associated with a computerized apparatus with a memory;

installing the upgrade program code into the memory; and installing program code in the memory for recognizing a requirement for the upgrade program code to be downloaded via the means for accessing a memory.

8. The method as set forth in claim 7 further comprising:

providing an end-user option as to whether to download said upgrade program code.

9. The method as set forth in claim 7 the installing the upgrade program code into the memory; further comprising:

providing sets of partial upgrade program code in a plurality of separate consumables such that a complete upgrade program code is delivered by use of one set of the plurality of separate consumables.

10. The method as set forth in claim 7 the installing the upgrade program code into the memory further comprising:

installing upgrade versions of computer code containing at least one downloadable, upgrade version of program code associated with a device selected from a group including, the consumable, the associated computerized apparatus, and interactional program code associated with both the consumable device and the associated computing apparatus.

11. A method of doing business, the method comprising:

manufacturing consumables employed with associated computerized apparatus;

incorporating upgrade versions of computer code into said consumables; and distributing said consumables to computerized apparatus end-users.

12. The method as set forth in claim 11 the incorporating upgrade versions of computer code into said consumables comprising:

incorporating upgrade versions of computer code containing at least one downloadable, upgrade version of program code associated with a device selected from a group including, the consumable, the associated computerized apparatus, and interactional program code associated with both the consumable device and the associated computing apparatus.

* * * * *